US011473271B2

(12) United States Patent
Metzger et al.

(10) Patent No.: US 11,473,271 B2
(45) **Date of Patent: *Oct. 18, 2022**

(54) ELECTRICAL CONTROL OF A HYDRAULIC SYSTEM

(71) Applicant: Caterpillar Inc., Peoria, IL (US)

(72) Inventors: Rustin Glenn Metzger, Congerville, IL (US); Corey Lee Gorman, Peoria, IL (US); Adam Martin Nackers, Hyogo (JP)

(73) Assignee: Caterpillar Inc., Peoria, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/301,867

(22) Filed: Apr. 16, 2021

(65) Prior Publication Data

US 2021/0301500 A1 Sep. 30, 2021

Related U.S. Application Data

(63) Continuation of application No. 16/834,810, filed on Mar. 30, 2020, now Pat. No. 11,001,989.

(51) Int. Cl.
*E02F 9/22* (2006.01)
*F15B 13/02* (2006.01)

(52) U.S. Cl.
CPC ..... *E02F 9/2225* (2013.01); *E02F 9/2278* (2013.01); *F15B 13/026* (2013.01); *F15B 2211/50572* (2013.01)

(58) Field of Classification Search
CPC ..... F15B 13/026; F15B 2211/50572; F15B 2211/50563; F15B 21/087;
(Continued)

(56) References Cited

U.S. PATENT DOCUMENTS 6,321,152 B1 * 11/2001 Amborski ..... F15B 11/162 701/50
6,498,973 B2 * 12/2002 Dix ..... F15B 21/087 701/50
(Continued)

FOREIGN PATENT DOCUMENTS

CN 103597220 B 2/2016
CN 105102726 B 6/2017
(Continued)

OTHER PUBLICATIONS

Written Opinion and International Search Report for International Patent Appln No. PCT/US2021/022874, dated Jul. 6, 2021 (13 pgs).

*Primary Examiner* — Thomas E Lazo
(74) *Attorney, Agent, or Firm* — Harrity & Harrity LLP

(57) ABSTRACT

A hydraulic system controller is disclosed. The hydraulic system controller may determine a maximum active circuit pressure of a set of active hydraulic circuits of the hydraulic system, wherein the hydraulic system includes a hydraulic pump to cause fluid to flow throughout the set of active hydraulic circuits; determine a circuit pressure of a hydraulic circuit of the hydraulic system; determine, based on a hydraulic flow command for the hydraulic circuit and the circuit pressure, a desired circuit delta-pressure for the hydraulic circuit; determine, based on the desired circuit delta-pressure and a pressure difference between the maximum active circuit pressure and the circuit pressure, a circuit valve setting for a circuit valve of the hydraulic circuit; and cause a control device to set a position of the circuit valve according to the circuit valve setting.

20 Claims, 5 Drawing Sheets

(58) Field of Classification Search
CPC ..... F15B 2211/781; F15B 2211/11162; F15B 2211/57; E02F 9/2225; E02F 9/2278
See application file for complete search history.

(56) References Cited

U.S. PATENT DOCUMENTS

| | | | | |
|---|---|---|---|---|
| 6,810,663 | B2 * | 11/2004 | Konishi | E02F 9/2228 60/429 |
| 9,284,718 | B2 * | 3/2016 | Hijikata | E02F 9/2292 |
| 9,725,884 | B2 * | 8/2017 | Hashimoto | E02F 9/2292 |
| 9,933,328 | B2 * | 4/2018 | Rannow | G01M 3/2807 |
| 10,858,805 | B2 | 12/2020 | Takahashi et al. | |
| 11,001,989 | B1 * | 5/2021 | Metzger | E02F 9/2278 |
| 2014/0069091 | A1 * | 3/2014 | Franzoni | F15B 13/022 60/429 |
| 2015/0284934 | A1 * | 10/2015 | Suk | E02F 9/265 60/427 |
| 2016/0040398 | A1 | 2/2016 | Kitajima et al. | |
| 2016/0265187 | A1 * | 9/2016 | Baba | E02F 3/963 |
| 2017/0121930 | A1 | 5/2017 | Kitajima et al. | |
| 2018/0030692 | A1 * | 2/2018 | Kamoshita | E02F 9/2253 |
| 2019/0186105 | A1 | 6/2019 | Imura et al. | |
| 2019/0194904 | A1 | 6/2019 | Karasawa et al. | |
| 2019/0234050 | A1 * | 8/2019 | Kim | F15B 21/087 |

FOREIGN PATENT DOCUMENTS

| | | | |
|---|---|---|---|
| CN | 105008623 | B | 7/2017 |
| CN | 105324540 | B | 12/2017 |
| CN | 109477502 | A | 3/2019 |
| JP | 4807888 | B2 | 8/2011 |
| JP | 2017190858 | A | 10/2017 |
| WO | 2019/142244 | A1 | 7/2019 |

* cited by examiner

ELECTRICAL CONTROL OF A HYDRAULIC SYSTEM

RELATED APPLICATION

This application is a continuation of U.S. patent application Ser. No. 16/834,810, filed Mar. 30, 2020, which is incorporated herein by reference in its entirety.

TECHNICAL FIELD

The present disclosure relates generally to a hydraulic system and, for example, to electrical control of a hydraulic system.

BACKGROUND

Work machines or construction machines, such as excavators or other similar types of vehicles, may be used to perform one or more worksite operations (e.g., material transfer, digging, scraping, dozing, and/or the like). Typically, such machines include a hydraulic system to perform the worksite operations to control movement of the machines and/or a component of the machines. For example, a hydraulic system may be used to control an implement of a machine. More specifically, a hydraulic system of an excavator may be used to control movement of the excavator, rotation of a body of the excavator (e.g., for a swing operation), and/or movement of an implement of the excavator that includes a boom, stick, bucket, and/or the like.

In many instances, the hydraulic system includes a plurality of hydraulic pumps and/or hydraulic circuits that individually include a plurality of circuit valves. More specifically, a hydraulic circuit, in previous techniques, may include a main spool valve that permits or denies flow through the individual circuits and a flow control valve to hydromechanically control the flow of fluid throughout the hydraulic system based on a sensed pressure of the hydraulic circuit and a hydraulic flow command, which may be based on an operator input to the hydraulic system. Accordingly, in such cases, hydraulic flow balance among the individual hydraulic circuits is achieved via hydromechanical control of one or more of a plurality of valves within the individual hydraulic circuits.

One approach for a construction machine control is disclosed in Chinese Patent No. CN105008623 that issued to Akinori et al. on Jul. 14, 2017 ("the '623 patent"). In particular, the '623 patent describes a work equipment control that controls a control valve, a pilot hydraulic line opening, and includes a pressure sensor.

While the '623 patent describes detecting a pilot pressure adjusted by the control valve, in the '623 patent, after a pressure adjustment has been provided by a first control valve of the supplied hydraulic oil to the directional control valve, a spool is moved to one side in an axial direction; and after a pressure adjustment has been provided by a second control valve of the supplied hydraulic oil to the directional control valve, the spool is moved to another side in the axial direction.

SUMMARY

According to some implementations, a method may include identifying a set of active hydraulic circuits of the hydraulic system, wherein the hydraulic system includes a hydraulic pump to cause fluid to flow throughout the set of active hydraulic circuits; determining a maximum active circuit pressure from active circuit pressures of the set of active hydraulic circuits; comparing the maximum active circuit pressure to a circuit pressure of a hydraulic circuit of the hydraulic system to determine a pressure difference between the maximum active circuit pressure and the circuit pressure; determining, based on a hydraulic flow command for the hydraulic circuit and the circuit pressure, a desired circuit delta-pressure for the hydraulic circuit; determining, based on the desired circuit delta-pressure being associated with a reduction in pressure that is less than the pressure difference, a circuit valve setting for a circuit valve of the hydraulic circuit that corresponds to the reduction in pressure; and causing a control device to set a position of the circuit valve according to the circuit valve setting to reduce the pressure difference.

According to some implementations, a hydraulic system controller may include a memory and a processor, communicatively coupled to the memory, that is configured to: obtain a circuit pressure of a hydraulic circuit of a hydraulic system, wherein the hydraulic system includes a hydraulic pump to cause fluid to flow throughout a set of active hydraulic circuits; determine active circuit pressures of the set of active hydraulic circuits; determine, from the active circuit pressures, a maximum active circuit pressure of the hydraulic system; determine, based on a hydraulic flow command for the hydraulic circuit and the circuit pressure, a desired circuit delta-pressure for the hydraulic circuit; determine, based on the desired circuit delta-pressure and a pressure difference between the maximum active circuit pressure and the circuit pressure, a circuit valve setting for a circuit valve of the hydraulic circuit; and instruct, based on the circuit valve setting, a control device to set a position of the circuit valve to reduce an opening through the circuit valve and reduce the pressure difference.

According to some implementations, a hydraulic system may include a hydraulic pump to provide, from a main line, a fluid to the hydraulic system; a plurality of hydraulic circuits configured to control a plurality of components of the machine; a plurality of circuit valves to control respective flows of the fluid through the plurality of hydraulic circuits; and a controller configured to: determine a maximum active circuit pressure of a set of active hydraulic circuits of the hydraulic system, wherein the hydraulic system includes a hydraulic pump to cause fluid to flow throughout the set of active hydraulic circuits; determine a circuit pressure of a hydraulic circuit of the hydraulic system; determine, based on a hydraulic flow command for the hydraulic circuit and the circuit pressure, a desired circuit delta-pressure for the hydraulic circuit; determine, based on the desired circuit delta-pressure and a pressure difference between the maximum active circuit pressure and the circuit pressure, a circuit valve setting for a circuit valve of the hydraulic circuit; and cause a control device to set a position of the circuit valve according to the circuit valve setting.

DETAILED DESCRIPTION

This disclosure relates to electrical (or electronic) control of a hydraulic system using a hydraulic system controller. The hydraulic system controller has universal applicability to any machine utilizing such a hydraulic system. The term "machine" may refer to any machine that performs an operation associated with an industry such as, for example, mining, construction, farming, transportation, or any other industry. As some examples, the machine may be a vehicle, a backhoe loader, a cold planer, a wheel loader, a compactor, a feller buncher, a forest machine, a forwarder, a harvester, an excavator, an industrial loader, a knuckleboom loader, a material handler, a motor grader, a pipelayer, a road reclaimer, a skid steer loader, a skidder, a telehandler, a tractor, a dozer, a tractor scraper, or other above ground equipment, underground equipment, or marine equipment. Moreover, one or more implements may be connected to the machine and driven from hydraulic components (e.g., cylinders, actuators, solenoids, valves, and/or the like) of hydraulic circuits of the hydraulic system and/or controlled by the hydraulic system controller, as described herein.

Figure 1:
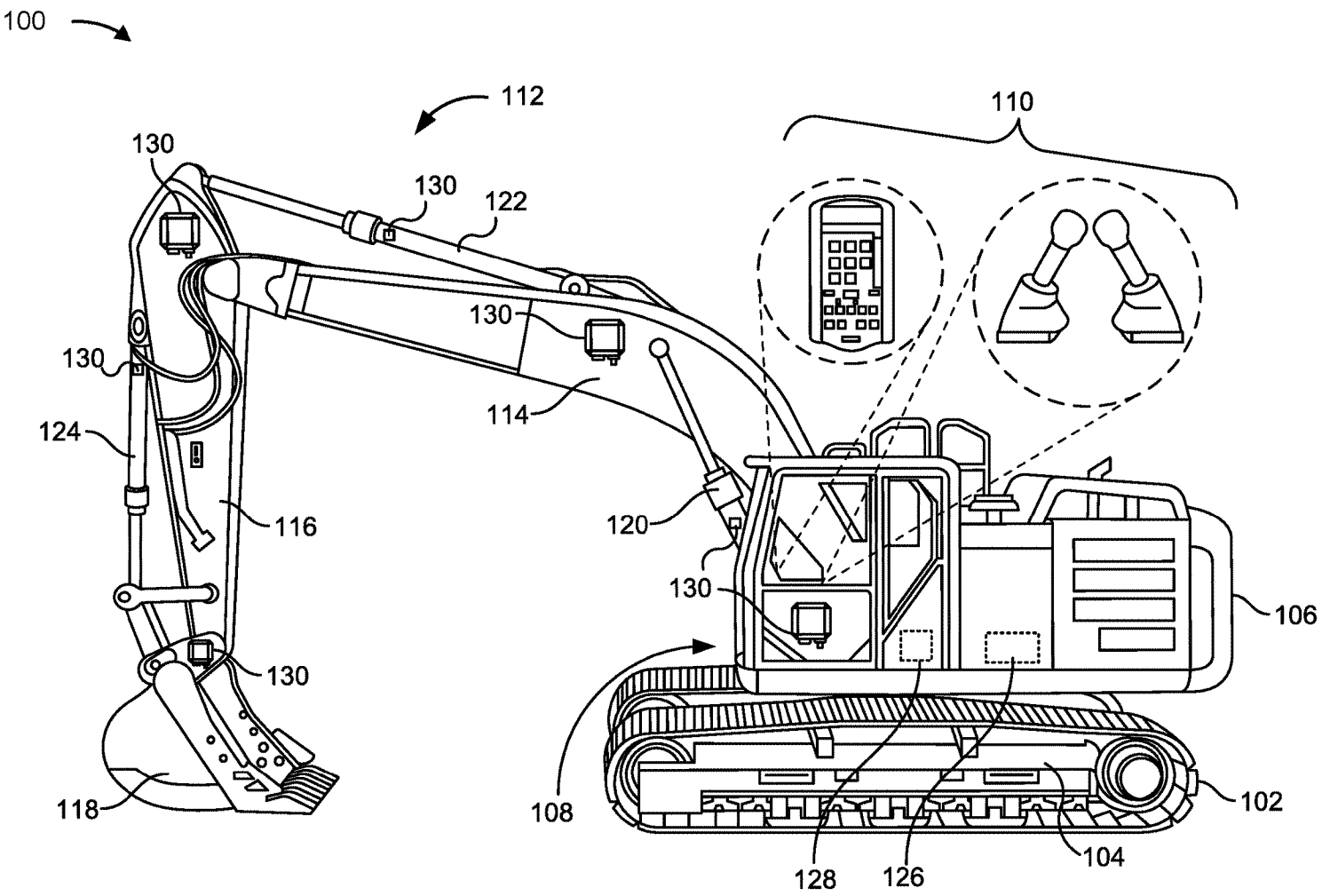
FIG. 1 is diagram of an example machine described herein.

FIG. 1 is a diagram of an example machine 100 described herein. As shown in FIG. 1, machine 100 is embodied as an earth moving machine, such as an excavator. Alternatively, the machine 100 may be a haul truck, a dozer, a loader, a backhoe, an excavator, a motor grader, a wheel tractor scraper, another earth moving machine, and/or the like.

As shown in FIG. 1, machine 100 includes ground engaging members 102, such as tracks, wheels, rollers, and/or the like, for propelling machine 100. Ground engaging members 102 are mounted on a car body 104 and are driven by one or more engines and/or drive trains. The car body 104 supports a rotatable machine body 106 and an operator station 108. The operator station 108 is supported by and/or is included within the machine body 106, which may be supported by a rotatable frame situated between the machine body 106 and the car body 104. The operator station 108 includes one or more operator interfaces 110 (shown as an integrated display and operator control devices, such as joysticks).

As shown in FIG. 1, machine 100 includes an implement 112 that includes a boom 114, a stick 116, and a bucket 118. The implement 112 may include other types of work tools, such as a hammer drill, ripper, and/or the like. As described herein, movement of the machine body 106 and/or movement of the implement 112 (e.g., relative to the machine body 106) may be controlled and/or performed via a hydraulic system. As described herein, the hydraulic system may include a plurality of hydraulic circuits to individually and/or independently control one or more functions of the machine 100, the machine body 106, and/or the implement 112. Such functions and/or operations may include a boom-in or boom-out operation associated with the boom 114, a stick-in or stick-out operation associated with the stick 116, a bucket-in or bucket-out operation associated with the bucket 118, a swing function associated with the machine body 106, and/or the like. Such functions may be performed in associated with one or more operations of the machine (e.g., a dig operation, a material transfer operation, a travel operation, and/or the like).

As shown in FIG. 1, the boom 114 is pivotably mounted to the machine body 106 at a proximal end of the boom 114. The boom 114 can be articulated relative to the machine body 106 by a boom cylinder 120 (e.g., a fluid actuation cylinders, such as a hydraulic cylinder, a pneumatic cylinder, and/or the like) of the hydraulic system. A proximal end of the stick 116 is pivotably mounted to the boom 114 at a distal end of the boom 114. The stick 116 can be articulated relative to boom 114 by a stick cylinder 122 of the hydraulic system. A proximal end of the bucket 118 is pivotably mounted to the stick 116 at a distal end of the stick 116. The bucket 118 can be articulated relative to the stick 116 by a bucket cylinder 124 of the hydraulic cylinder.

The hydraulic system of the machine 100 may include a hydraulic pump 126 that is to provide a flow source (e.g., a fixed flow rate or variable flow rate) of fluid (e.g., oil or other type of hydraulic fluid) to a plurality of hydraulic circuits (e.g., individual hydraulic circuits associated with the boom cylinder 120, the stick cylinder 122, the bucket cylinder 124, one or more swing cylinders to swing the machine body 106, and/or the like) of the hydraulic system. According to some implementations, the hydraulic pump 126 may be a single (or the only) hydraulic pump 126 that is configured to control a plurality of functions described herein. Additionally, or alternatively, the hydraulic pump 126 may be one of a plurality of hydraulic pumps that are configured to, in combination, provide a single flow source of fluid to the hydraulic system of the machine. The hydraulic pump 126 provides the fluid, from a main line fluidly coupled to a discharge end of the hydraulic pump to the plurality of hydraulic circuits. As described herein, flow through the plurality of hydraulic circuits may be controlled via electromechanical control of individual circuit valves of the plurality of hydraulic circuits. As further described herein, a circuit valve of an individual hydraulic circuit may be the only (or a single) circuit valve of the individual hydraulic circuit.

As shown in FIG. 1, machine 100 may include a controller 128 (e.g., an electronic control module (ECM)) and a plurality of sensors 130 (referred to herein individually as a "sensor 130," and collectively referred to collectively as "sensors 130"). The controller 128 may control and/or monitor operations of machine 100. For example, the controller 128 may control and/or monitor the operations of machine 100 based on signals from the sensors 130 and/or and operator inputs received from operator interfaces 110. The controller 128 may include and/or be associated with a hydraulic system controller that is configured to control the hydraulic system, as described herein.

As shown in FIG. 1, the sensors 130 are installed at different positions on and/or within various components or portions of machine the 100. For example, sensors 130 may include one or more motion sensors (e.g., cameras, accelerometers, gyroscopes, inertial measurement sensors, speed sensors, position sensors, and/or the like) may be positioned on the machine body 106, the boom 114, the stick 116, and the bucket 118. In such an example, the controller, from information received from the sensors 130, may detect and/or determine movement of the machine 100, movement of the machine body, movement of the implement 112, a position of the machine 100 (e.g., relative to an environment of the machine 100), an orientation of the machine 100, and/or the like. Additionally, or alternatively, sensors 130 may include one or more pressure sensors included within the actuation cylinders (e.g., at a head end, at a rod end, within a fluid line to or from the actuation cylinders, and/or the like) of the machine 100. In such an example, the controller 128 may determine one or more pressures associated with the boom cylinder 120, the stick cylinder 122, the bucket cylinder 124, a swing cylinder, and/or the like.

As indicated above, FIG. 1 is provided as an example. Other examples may differ from what was described in connection with FIG. 1.

Figure 2:
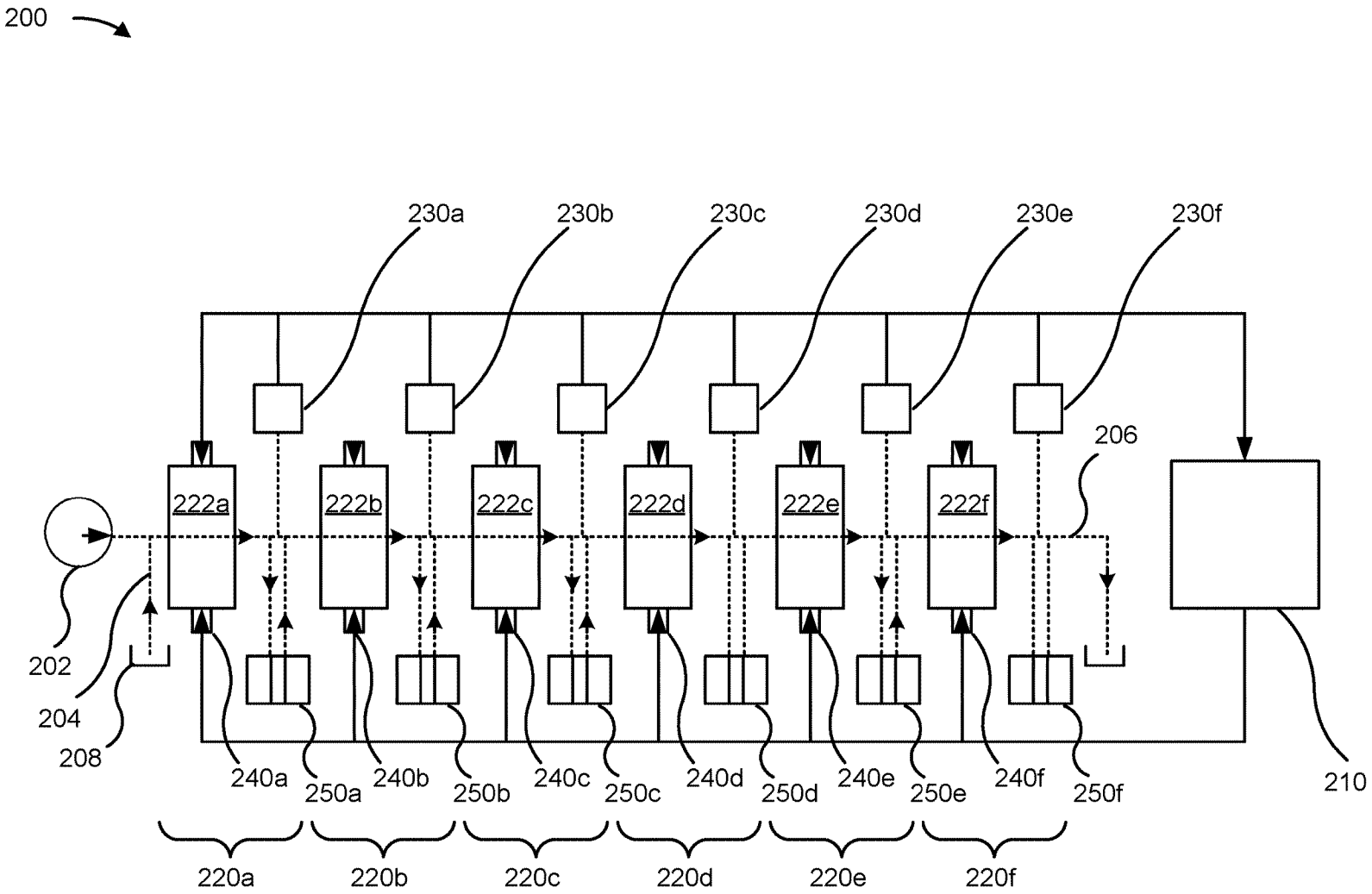
FIG. 2 is a schematic diagram of an example hydraulic system described herein.

FIG. 2 is a schematic diagram of an example hydraulic system 200 described herein. Hydraulic system 200 includes a hydraulic pump 202, a feed line 204, a main line 206, a fluid reservoir 208, a controller 210, and a plurality of hydraulic circuits 220*a* to 220*f* (referred to herein collectively as "hydraulic circuits 220"). The feed line 204 is fluidly coupled to the fluid reservoir 208 and to an intake end of the hydraulic pump 202. The hydraulic pump 202 may be any suitable fluid pumping mechanism that is configured to draw, via the feed line 204, fluid from the fluid reservoir 208 to cause the fluid to flow through the main line 206 to the hydraulic circuits 220 and back to the fluid reservoir 208. The main line 206 is fluidly coupled to a discharge of the pump, to circuit lines (and/or circuit valves) of the hydraulic circuits 220, and to the fluid reservoir 208. The main line 206 may be a single flow source that is configured to supply respective flows of fluid through the hydraulic circuits 220. The controller 210 may correspond to controller 128 of FIG. 1 and be configured to control the flow of fluid through the hydraulic circuits, as described herein.

In FIG. 2, the hydraulic circuits 220 individually include circuit valves 222*a* to 222*f*, respectively (referred to collective as "circuit valves 222"), and pressure sensor configurations 230*a* to 230*f*, respectively (referred herein to collectively as "pressure sensor configurations 230), valve control devices 240*a* to 240*f*, respectively (referred herein to collective as "valve control devices 240"), and cylinders 250*a* to 250*f*, respectively (referred herein to collective as "cylinders 250"). The hydraulic circuits 220 may be associated with individual functions of the machine 100 and/or the implement 112 of FIG. 1. As a specific example, the hydraulic circuit 220*a* and hydraulic circuit 220*b* may control directional movement of the machine 100, the hydraulic circuit 220*c* may control swing (or rotation) of the machine body 106, the hydraulic circuit 220*d* may control the boom 114 (e.g., cylinder 250*d* may correspond to boom cylinder 120), the hydraulic circuit 220*e* may control the stick 116 (e.g., cylinder 250*e* may correspond to stick cylinder 122), and the hydraulic circuit 220*f* may control the bucket 118 (e.g., cylinder 250*f* may correspond to bucket cylinder 124).

The circuit valves 222 may be any suitably configured valve that is capable of being controlled by the respective valve control devices 240 (e.g., based on receiving instructions from controller 210). For example, the circuit valves 222 may be individually configured spool valves with electromechanical configurations that are configured specific for functional control of the cylinders 250 (e.g., according to responsiveness, performance, sizes, ranges of operation, cylinder type, and/or the like).

The hydraulic pump 202, during operation, and according to configurations of the circuit valves 222 (e.g., based on a setting or a position of the circuit valves), causes fluid to flow to, through, and/or from the hydraulic circuits 220. In the example of FIG. 2, which includes a hydraulic pump 202, any adjustment to an opening of one of the circuit valves 222 would likely affect, due to physical properties of the hydraulic system 200, the flow through other hydraulic circuits 220 that are not associated with the circuit valve 222. For example, closing or reducing an area of circuit valve 222*a* may increase the flow rate of fluid through any of the hydraulic circuits 220*b* to 220*f* that are active. On the other hand, opening or increasing an area of circuit valve 222*a* may decrease the flow rate of fluid through any of the hydraulic circuits 220*b* to 220*f* that are active. As described herein, a hydraulic circuit 220 is an "active circuit" when the corresponding circuit valve 222 has an open passageway that permits fluid to flow through that hydraulic circuit 220.

The pressure sensor configurations 230 may include one or more pressure sensors that are configured to monitor individual pressures of the hydraulic circuits 220. For example, pressure sensor configuration 230*a* may include a first pressure sensor to measure and/or indicate a pressure at a rod end of cylinder 250*a*, a pressure at a head end of cylinder 250*a*, and/or a pressure within a circuit line between the circuit valve 222*a* and cylinder 250*a*. As shown, the pressure sensor configurations are communicatively coupled with the controller 210. Accordingly, the controller 210 may receive, obtain, and/or monitor pressure measurements associated with the hydraulic system 200.

As described herein, the controller 210 causes the valve control devices 240 to configure or position one or more components (e.g., spools, stems, actuators, plugs, apertures, and/or the like) of the circuit valves 222 to increase and/or decrease an opening of the circuit valves 222 (e.g., by increasing or decreasing an area of a passageway that flows through one or more of the respective circuit valves 222). More specifically, the controller 210 may instruct the valve control devices 240 to set positions of spools of the circuit valves 222 to control the sizes of openings and, correspondingly, the flow of the fluid throughout the hydraulic circuits 220 (e.g., according to a hydraulic flow command of the hydraulic system, of one or more of the hydraulic circuits 220, and/or the like).

As indicated above, FIG. 2 is provided as an example. Other examples may differ from what was described in connection with FIG. 2.

Figure 3:
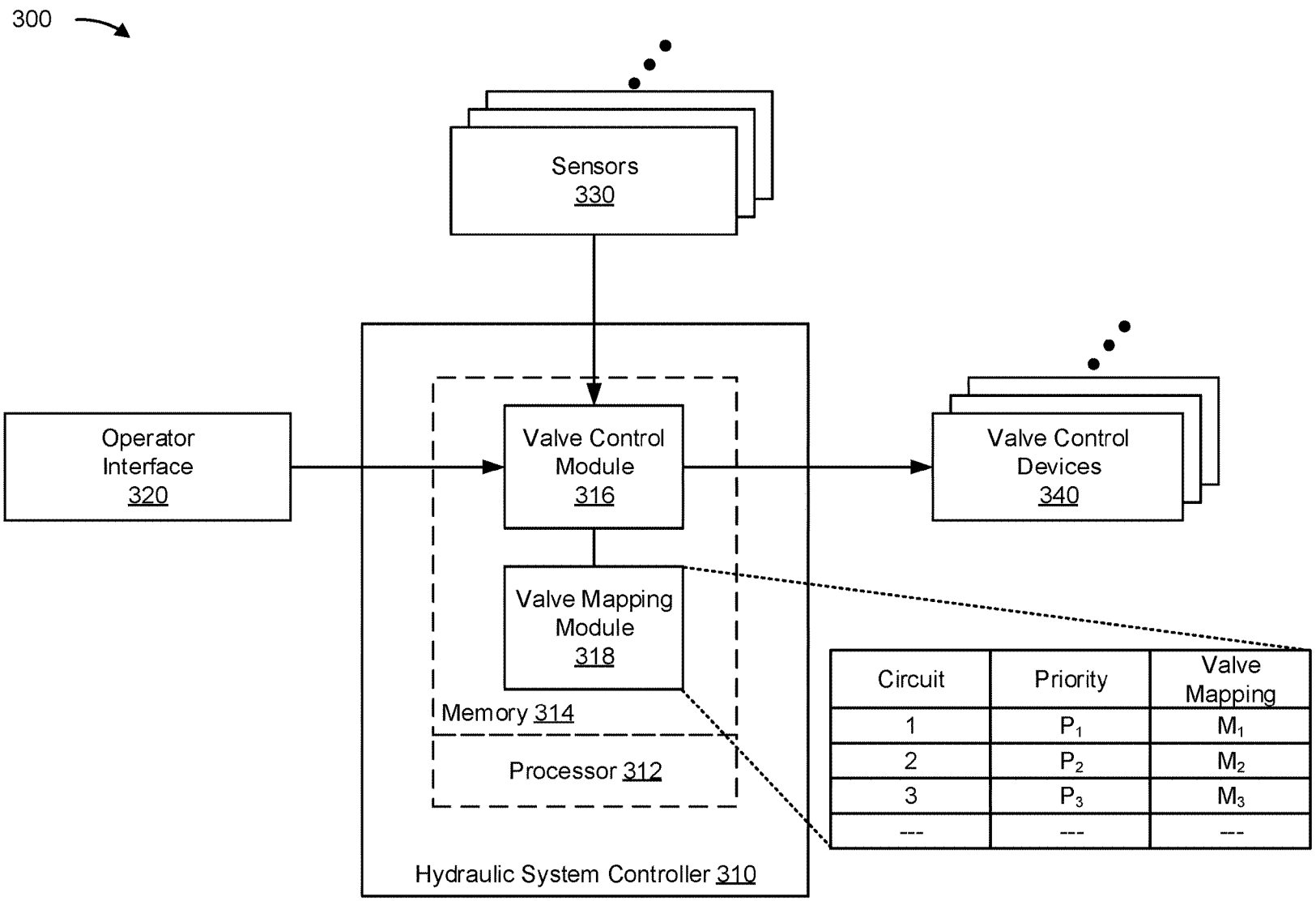
FIG. 3 is a diagram of an example system in which example devices and/or example methods, described herein, may be implemented.

FIG. 3 is a diagram of an example system 300 in which example devices and/or example methods, described herein, may be implemented. As shown in FIG. 3, system 300 may include a hydraulic system controller 310 that includes a processor 312, a memory 314, a valve control module 316, and a valve mapping module 318. Furthermore, system 300 may include an operator interface 320, sensors 330, and/or valve control devices 340 (referred to herein individually as "control device 340"). Devices of system 300 may interconnect via wired connections, wireless connections, or a combination of wired and wireless connections. As described herein, hydraulic system controller 310 is configured to control, using the valve control devices 340, a hydraulic system (e.g., the hydraulic system 200 of FIG. 2) according to a hydraulic flow command determined based on an operator input from operator interface 320, based on sensor measurements from sensors 330, and/or the like.

Operator interface 320 (e.g., corresponding to operator interface 110 of FIG. 1) may include one or more devices associated with receiving, generating, storing, processing, and/or providing information associated with controlling the machine 100 and/or implement 112. Such input components may include an electronic user interface (e.g., a touchscreen, a keyboard, a keypad, and/or the like), a mechanical user interface (e.g., an accelerator pedal, a decelerator pedal, a brake pedal, a gear shifter for a transmission, and/or the like), and/or a hydraulic user interface (e.g., a hydraulic level, a hydraulic pedal, and/or the like). As described herein, hydraulic system controller 310 may determine a hydraulic flow command based on an operator input that is received from the operator interface 320.

The sensors 330 may include any type of sensor configured to monitor operating conditions of machine 100 and/or implement 112. The sensors 330 may correspond to the sensors 130 of FIG. 1 and/or the pressure sensor configurations 230 of FIG. 2. The sensors 330 may include one or more sensors to determine an operating condition of the machine 100 and/or the implement, such as pressure sensors (e.g., to determine a pressure within a line and/or cylinder of hydraulic system, a pressure within an engine of the machine 100, and/or the like), temperature sensors (e.g., to detect temperature of air, exhaust, a component, coolant, and/or the like), position sensors (e.g., to detect a position of a valve, an actuator, an engine part (e.g., a piston), and/or the like), speed sensors (e.g., to detect a machine speed, an engine speed, and/or the like), and/or the like.

The valve control device 340 includes any suitable device that may be used by hydraulic system controller 310 to electrically control a flow of fluid through one or more hydraulic circuits (e.g., the hydraulic circuits 220 of FIG. 2). For example, control device 340 may include one or more actuators, solenoids, switches, and/or the like that are capable of opening and/or closing a circuit valve (e.g., the circuit valves 222 of FIG. 2). In some implementations, the valve control device 340 may provide feedback to hydraulic system controller 310. For example, the valve control device 340 may provide and/or indicate the position of a spool (or other component) of the circuit valve, whether the circuit valve is opened or closed, an area of an opening of the circuit valve, and/or the like. Additionally, or alternatively, one or more of the sensors 330 may be associated with and/or included within the valve control device 340. In such a case, the sensors 330 may provide information that is associated with the valve control device 340 and/or that may be representative of a state or setting of the circuit valve associated with the valve control device 340.

Hydraulic system controller 310 may correspond to controller 128 of FIG. 1 and/or controller 210 of FIG. 2. Processor 312 is implemented in hardware, firmware, and/or a combination of hardware and software. Processor 312 may include a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. Processor 312 may include one or more processors capable of being programmed to perform a function. Memory 314 includes a random-access memory (RAM), a read only memory (ROM), and/or another type of dynamic or static storage device (e.g., a flash memory, a magnetic memory, and/or an optical memory) that stores information and/or instructions for use by processor 312 (e.g., information and/or instructions associated with valve control module 316, and a valve mapping module 318, and/or the like).

The valve control module 316 is configured to determine and/or control valve control devices 340 to control a flow rate of fluid through one or more hydraulic circuits of the machine 100. The valve control module 316 may receive measurements from sensors 330 associated with operating conditions of the machine 100 and/or the implement 112. Additionally, or alternatively, the valve control module 316 may receive operator inputs from operator interface 320 in association with an operator performing operation associated with the machine 100 and/or the implement and/or controlling a function of the machine 100 and/or the implement 112, as described herein.

The valve control module 316 may be configured to monitor pressures of the hydraulic system using a plurality of pressure sensors of sensors 330. Based on the pressures throughout the hydraulic system, the valve control module 316 may instruct the valve control devices 340 to adjust a setting of one or more circuit valves to cause a flow rate of through a particular hydraulic circuit to increase or decrease. For example, the valve control module 316 may identify, based on the pressures and/or an operator input, which hydraulic circuits of the hydraulic system are active (e.g., which hydraulic circuits have a non-zero flow rate). For those hydraulic circuits that are active, the valve control module 316 may determine a maximum active circuit pressure (e.g., a highest circuit pressure relative to the circuit pressures of the active hydraulic circuits). The valve control module 316 may compare the maximum active circuit pressure to a desired circuit delta-pressure for a hydraulic circuit (e.g., one of the active hydraulic circuits), and determine whether an area of a circuit valve for that can be reduced to increase a flow rate of fluid for the hydraulic circuit that has the maximum active circuit pressure.

The valve control module 316 may determine the desired circuit delta-pressure for a particular hydraulic circuit based on a desired hydraulic flow command (e.g., as determined from an operator input of the operator interface 320, an automated flow command generated based on sensor measurements of the sensors 330, and/or the like) and an actual or operating pressure as indicated by one of the sensors 330 monitoring the hydraulic circuit. If the desired circuit delta-pressure indicates that the area can be reduced (e.g., the measured pressure is higher than a pressure corresponding to the hydraulic flow command), the valve control module 316, using the valve mapping module 318, instructs the valve control device 340 of the hydraulic circuit to correspondingly reduce the area of the circuit valve of the hydraulic circuit. In this way, the flow rate (and/or pressure) of the hydraulic circuit associated with the maximum active circuit pressure could be increased by control of the other circuit valve.

The valve control module 316 may store information and/or logic in the valve mapping module 318. For example, such information may be included in a list of hydraulic circuits (and/or corresponding circuit valves), a priority associated with the circuits (e.g., an indication of whether control for one or more hydraulic circuits is to be prioritized over another by default and/or under a particular condition), and a plurality of valve mappings (shown as "$M_1$," "$M_2$," "$M_3$") corresponding to certain circuit valves of hydraulic circuits of a hydraulic system. A valve mapping may map a position of a valve with a particular area of a circuit valve, a particular pressure of a hydraulic circuit, a particular flow rate for the hydraulic circuit, and/or the like. Accordingly, the valve mappings stored and/or maintained by the valve mapping module 318 may be valve-specific, operation-mode specific, and/or function-specific valve mappings. In this way, the valve control module 316 may cause the valve control devices 340 to saturate a delta-pressure compensation (e.g., an adjustment of an opening) according to a particular tuning strategy for the individual hydraulic circuits.

The valve mappings may be stored in a data structure (e.g., a database, a table, an index, a graph, and/or the like) of the memory 314 and/or in a memory that is communicatively coupled with the memory 314. The valve mappings may be associated with circuit valve settings for a desired pressure, a desired flow rate, a desired circuit delta-pressure, and/or the like. Further, a valve mapping, for a particular circuit valve, may correspond to a mapping of specific positions of a spool of the circuit valve to area of an opening of the valve for particular operating conditions of the machine 100 and/or the implement 112. In this way, a valve mapping identifies a circuit valve setting and/or a position for a component of a circuit valve. The valve control module 316 may use the valve mappings of the valve mapping module 318 to rate limit flow rates through one or more hydraulic circuits of the hydraulic system of the machine 100.

The number and arrangement of devices shown in FIG. 3 are provided as an example. In practice, there may be additional devices, fewer devices, different devices, or differently arranged devices than those shown in FIG. 3. Furthermore, two or more devices shown in FIG. 3 may be implemented within a single device, or a single device shown in FIG. 3 may be implemented as multiple, distributed devices. Additionally, or alternatively, a set of devices (e.g., one or more devices) of system 300 may perform one or more functions described as being performed by another set of devices of system 300.

Figure 4:
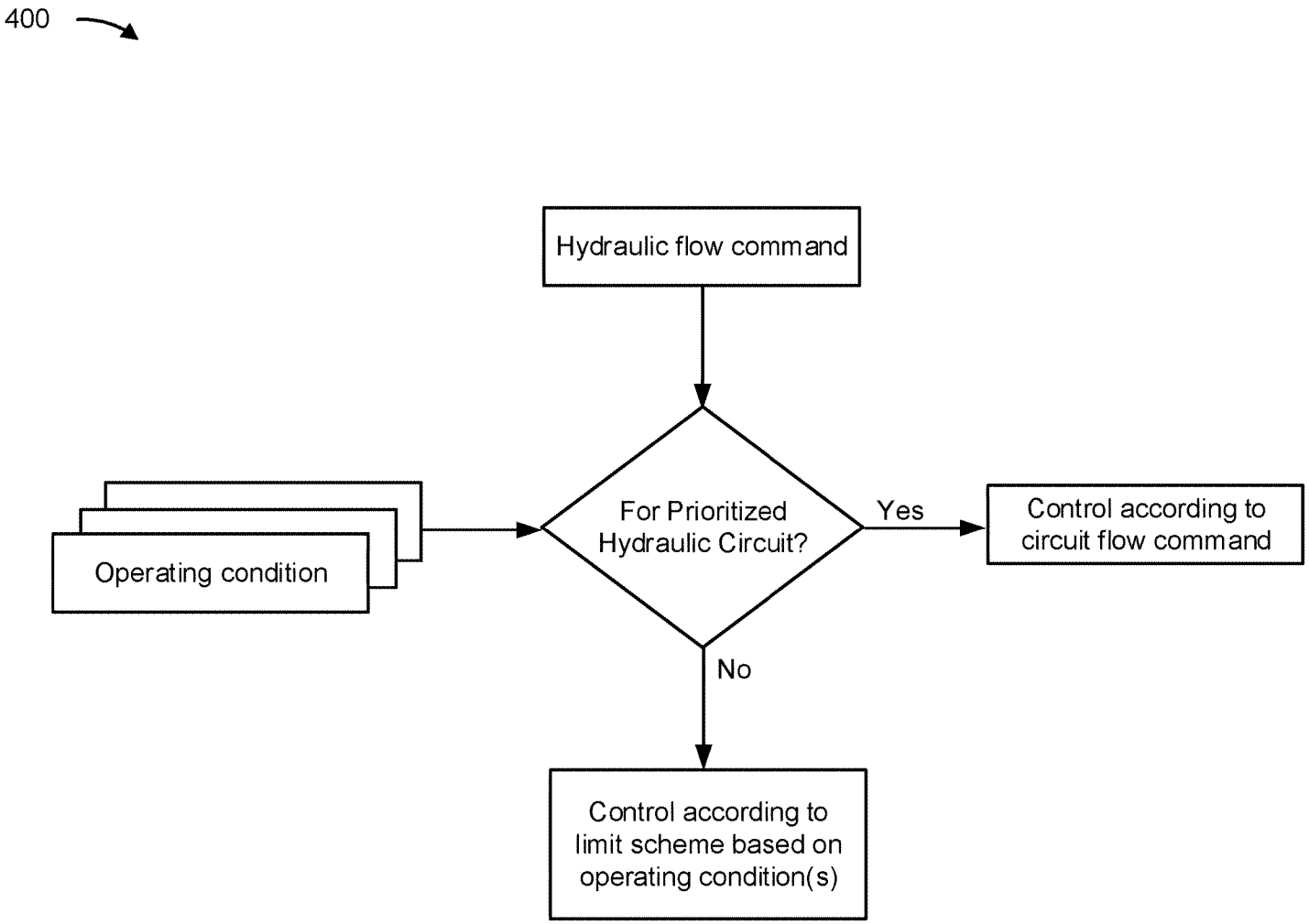
FIG. 4 is a diagram of an example associated with limiting a flow rate of a hydraulic circuit, as described herein described herein.

FIG. 4 is a diagram of an example 400 associated with limiting flow rate of a hydraulic circuit, as described herein described herein. The example 400 may correspond to a rate limit scheme and/or analysis performed by the hydraulic system controller 310 of FIG. 3.

As shown in FIG. 4, the hydraulic system controller 310 may determine whether a hydraulic flow command for a hydraulic circuit is associated with a prioritized hydraulic circuit according to one or more determined operating conditions associated with the machine 100 and/or the implement 112. If the hydraulic flow command is associated with a prioritized hydraulic circuit (which may be determined according to a valve mapping of the valve mapping module 318), the hydraulic system controller 310 controls the hydraulic system according to the hydraulic flow command. For example, the hydraulic system controller 310 may cause the valve control devices 340 of the hydraulic system to control flow rates of the active hydraulic circuits to meet the desired hydraulic flow command.

If the hydraulic system controller 310 determines that the hydraulic flow command is not associated with a prioritized hydraulic circuit according to the operating conditions, the hydraulic system controller 310 controls the hydraulic system according to a limit scheme that is based on the operating conditions. For example, the hydraulic system controller 310 may control the valve control devices 340 to limit the flow rate associated with one or more of the hydraulic circuits according to a rate limit strategy for the hydraulic circuits and/or according to an adjustment to the hydraulic flow command that is based on the operating conditions.

As an example, a stick-in function (e.g., for a dig operation), associated with the stick 116, can be limited based on the operating conditions indicating a swing velocity of the machine body 106 and/or a circuit pressure associated with the hydraulic circuit that controls the swinging of the machine body 106. In such a case, the hydraulic system controller 310 can cause a valve control device 340 to limit a flow rate of a hydraulic circuit of the stick 116 to be less than a particular maximum flow rate. Additionally, or alternatively, the stick-in function can be limited based on an ongoing boom flow command associated with the boom cylinder 120, a bucket flow command associated with the bucket cylinder 124, and/or a swing flow command associated with a swing cylinder. As another example, based on the operating conditions indicating that the machine 100 is moving (e.g., during a travel operation), a hydraulic flow command associated with bucket cylinder 124 can be ignored and/or adjusted to prevent reduction in the flow rate of the fluid that is being used to move the machine 100. Similarly, a hydraulic flow command for the boom cylinder 120 and/or stick cylinder can be ignored and/or adjusted during a move operation and/or other type of operating condition associated with the machine 100.

As indicated above, FIG. 4 is provided as an example. Other examples may differ from what was described in connection with FIG. 4.

Figure 5:
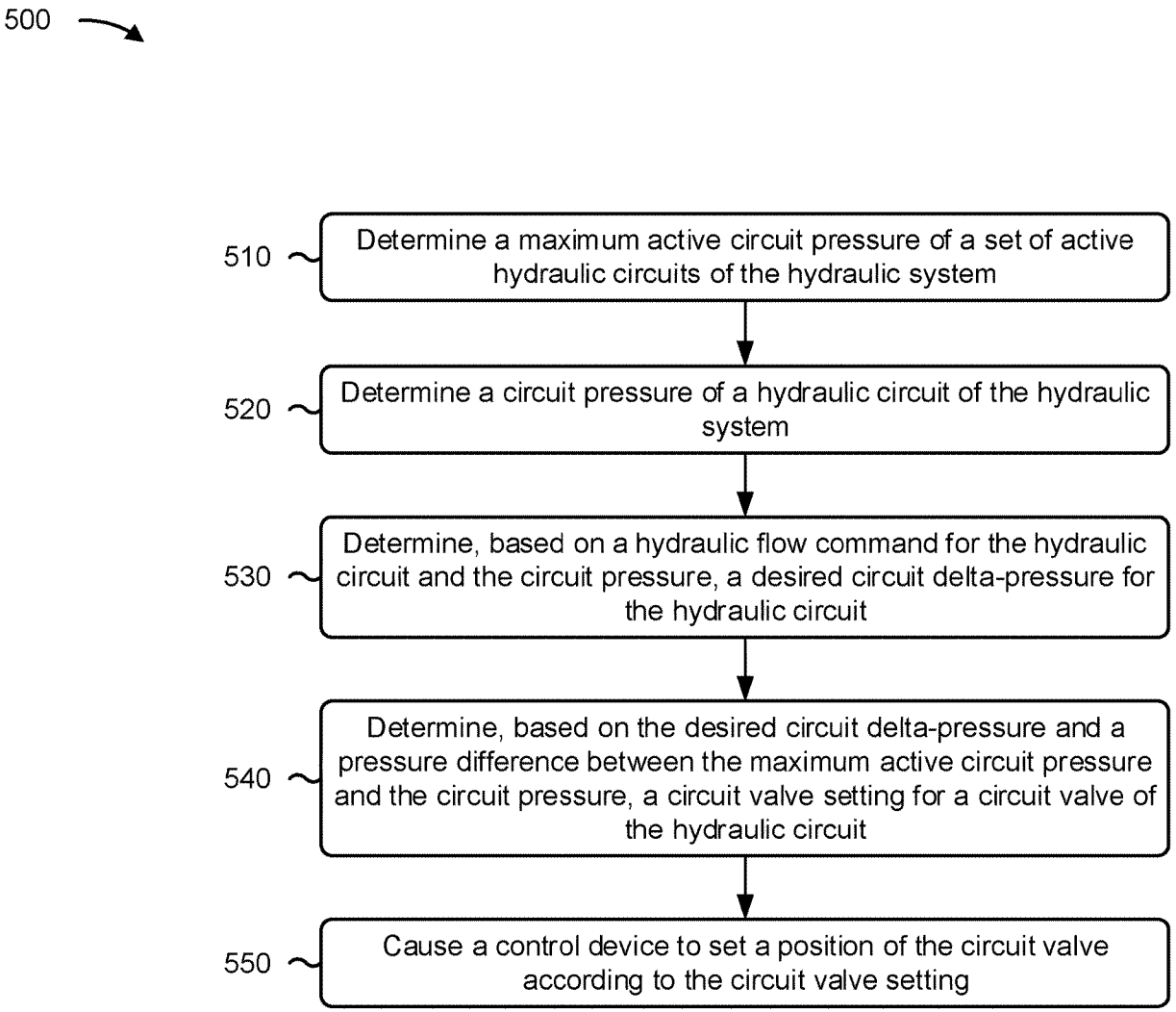
FIG. 5 is a flowchart of an example process associated with electrical control of a hydraulic system described herein.

FIG. 5 is a flowchart of an example process 500 associated with electrical control of a hydraulic system. In some implementations, one or more process blocks of FIG. 5 may be performed by a controller (e.g., controller 128, controller 210, hydraulic system controller 310, and/or the like). In some implementations, one or more process blocks of FIG. 5 may be performed by another device or a group of devices separate from or including the controller, such as a valve control device (e.g., valve control devices 240, valve control devices 340, and/or the like), and/or the like.

As shown in FIG. 5, process 500 may include determining a maximum active circuit pressure of a set of active hydraulic circuits of the hydraulic system (block 510). For example, the controller (e.g., using processor 312, memory 314, valve control module 316, valve mapping module 318, and/or the like) may determine a maximum active circuit pressure of a set of active hydraulic circuits of the hydraulic system, as described above. The hydraulic system may include a hydraulic pump and/or single flow source that is to cause fluid to flow throughout the set of active hydraulic circuits.

The controller may identify the set of active hydraulic circuits based on one or more hydraulic flow commands associated with controlling one or more hydraulic components of the hydraulic system. The controller may determine, from pressure sensors associated with the set of active hydraulic circuits, individual pressure measurements of the set of active hydraulic circuits, and identify, from the individual pressure measurements, the maximum active circuit pressure.

As further shown in FIG. 5, process 500 may include determining a circuit pressure of a hydraulic circuit of the hydraulic system (block 520). For example, the controller (e.g., using processor 312, memory 314, valve control module 316, valve mapping module 318, and/or the like) may determine a circuit pressure of a hydraulic circuit of the hydraulic system, as described above.

The hydraulic circuit may be one of the set of active hydraulic circuits. Additionally, or alternatively, the hydraulic circuit is a first hydraulic circuit, with a first circuit valve, of the hydraulic system and the maximum active circuit pressure is associated with a second hydraulic circuit of the hydraulic system that is different from the first hydraulic circuit. The first circuit valve and a second circuit valve of the second hydraulic circuit may be fluidly coupled to a main line of the hydraulic pump.

As further shown in FIG. 5, process 500 may include determining, based on a hydraulic flow command for the hydraulic circuit and the circuit pressure, a desired circuit delta-pressure for the hydraulic circuit (block 530). For example, the controller (e.g., using processor 312, memory 314, valve control module 316, valve mapping module 318, and/or the like) may determine a desired circuit delta-pressure for the hydraulic circuit, as described above. The controller may determine the hydraulic flow command based on an operator input associated with the hydraulic circuit, an operating condition of the hydraulic circuit, an operating condition of the hydraulic system, an operating condition of the machine, and/or the like.

The circuit pressure may correspond to an operating pressure received from a pressure sensor of the hydraulic circuit, and the desired circuit delta-pressure may include a difference between the operating pressure and a desired pressure that is based on the hydraulic flow command.

As further shown in FIG. 5, process 500 may include determining, based on the desired circuit delta-pressure and a pressure difference between the maximum active circuit pressure and the circuit pressure, a circuit valve setting for a circuit valve of the hydraulic circuit (block 540). For example, the controller (e.g., using processor 312, memory 314, valve control module 316, valve mapping module 318, and/or the like) may determine, based on the desired circuit delta-pressure and a pressure difference between the maximum active circuit pressure and the circuit pressure, a circuit valve setting for a circuit valve of the hydraulic circuit, as described above.

The controller may determine that the maximum active circuit pressure is greater than the circuit pressure, determine that the desired circuit delta-pressure indicates a desired reduction in pressure in the hydraulic circuit that is less than the pressure difference between the maximum active circuit pressure and the circuit pressure, and determine the position of the circuit valve that provides the desired reduction in pressure.

In some implementations, the controller may identify a valve mapping, associated with the hydraulic circuit, that maps a plurality of circuit pressures to corresponding positions of the circuit valve, and obtain, from the valve mapping and based on the desired circuit delta-pressure, the circuit valve setting, which may indicate a position for the circuit valve.

Additionally, or alternatively the controller may determine an operating condition associated with one of the set of active hydraulic circuits, determine, based on the operating condition, a flow rate limit associated with the hydraulic circuit, and determine the circuit valve setting based on the flow rate limit. The one of the set of active hydraulic circuits may be associated with controlling movement of a machine, and the hydraulic circuit may be associated with controlling a component of the machine.

As further shown in FIG. 5, process 500 may include causing a control device to set a position of the circuit valve according to the circuit valve setting (block 550). For example, the controller (e.g., using processor 312, memory 314, valve control module 316, valve mapping module 318, and/or the like) may cause a control device to set a position of the circuit valve according to the circuit valve setting, as described above. The controller may provide the circuit valve setting to the control device.

Although FIG. 5 shows example blocks of process 500, in some implementations, process 500 may include additional blocks, fewer blocks, different blocks, or differently arranged blocks than those depicted in FIG. 5. Additionally, or alternatively, two or more of the blocks of process 500 may be performed in parallel.

INDUSTRIAL APPLICABILITY

The disclosed hydraulic system controller may be used with any machine that uses a hydraulic system to control the machine and/or an implement of the machine. The disclosed hydraulic system controller may electrically control the flow of fluid through a plurality of hydraulic circuits based on monitoring and/or determining pressures associated with the hydraulic circuits. For example, based on a maximum active circuit pressure identified in one hydraulic circuit (e.g., a highest circuit pressure relative to a set of active hydraulic circuits), the hydraulic system controller may determine whether a circuit valve of another hydraulic circuit in the hydraulic system is to be adjusted to increase a flow rate of fluid through the hydraulic circuit that is associated with the maximum active circuit pressure (e.g., to improve performance and/or responsiveness of a function or component associated with the hydraulic circuit). In this way, based on being communicatively coupled with one or more pressure sensors and/or valve control devices, the hydraulic system controller can automatically control flow rate and/or fluid distribution throughout the hydraulic system.

Furthermore, the hydraulic system controller, as configured herein, enables a hydraulics system to include a hydraulic pump, because multiple (or all) hydraulic circuits can be simultaneously be monitored and controlled electromechanically, rather than hydromechanically. Moreover, because the hydraulic system controller electromechanically (rather than hydromechanically) controls circuit valves of the hydraulic system, the hydraulic system controller enables a hydraulic system that includes a plurality hydraulic circuits, to independently control the flow rates of fluid through the hydraulic circuits using individual circuit valves (e.g., one control valve per hydraulic circuit), while simultaneously controlling flow throughout the active hydraulic circuits. In this way, rather than a machine requiring a plurality of separate hydraulic pumps for a hydraulic system, and/or a plurality of separate circuit valves for a single hydraulic circuit, the hydraulic system can be controlled using a hydraulic pump, a single flow source, and/or singular circuit valves for hydraulic circuits of the hydraulic system controller, thus reducing a hardware resources, reducing complexity of the hydraulic system, and improving efficiencies associated with the hydraulic system and/or a machine associated with the hydraulic system (e.g., by reducing weight of the hydraulic system, power requirements and/or consumption of the hydraulic system, and/or the like).

What is claimed is:

1. A method for controlling a hydraulic system, comprising:

determining that a hydraulic flow command, for a hydraulic circuit of the hydraulic system, is not associated with a prioritized hydraulic circuit;

determining, after determining that the hydraulic flow command is not associated with a prioritized hydraulic circuit, a desired circuit delta-pressure for the hydraulic circuit based on the hydraulic flow command; and controlling the hydraulic system based on the desired circuit delta-pressure.

2. The method of claim 1, further comprising:

determining, based on the desired circuit delta-pressure, a circuit valve setting for a circuit valve of the hydraulic circuit, wherein controlling the hydraulic system comprises:

causing a control device to set a position of the circuit valve according to the circuit valve setting.

3. The method of claim 1, further comprising:

determining, based on the desired circuit delta-pressure and based on a flow rate limit associated with the hydraulic circuit, a circuit valve setting for a circuit valve of the hydraulic circuit, wherein controlling the hydraulic system comprises:

causing a control device to set a position of the circuit valve according to the circuit valve setting.

4. The method of claim 1, further comprising:

determining an operating condition associated with the hydraulic circuit; and determining, based on the operating condition, a flow rate limit associated with the hydraulic circuit, wherein the hydraulic system is controlled further based on the flow rate limit.

5. The method of claim 1, wherein determining the desired circuit delta-pressure comprises:

determining the desired circuit delta-pressure based on the hydraulic flow command and based on a circuit pressure of the hydraulic circuit.

6. The method of claim 5, wherein the circuit pressure corresponds to an operating pressure received from a pressure sensor of the hydraulic circuit.

7. The method of claim 1, wherein the desired circuit delta-pressure is based on a difference between an operating pressure, received from a pressure sensor of the hydraulic circuit, and a desired pressure that is based on the hydraulic flow command.

8. The method of claim 1, further comprising:

determining the hydraulic flow command based on an operating condition of the hydraulic circuit, the hydraulic system, or a machine that includes the hydraulic system.

9. A hydraulic system controller, comprising:

one or more memories; and one or more processors, coupled to the one or more memories, configured to:

determine a desired circuit delta-pressure for a hydraulic circuit, of a hydraulic system, based on a hydraulic flow command; and control, based on the desired circuit delta-pressure, a control device to set a position of a circuit valve of the hydraulic circuit.

10. The hydraulic system controller of claim 9, wherein the one or more processors are further configured to:

determine, based on the desired circuit delta-pressure, a circuit valve setting for the circuit valve, wherein the one or more processors, to control the control device, are configured to:

control the control device to set the position of the circuit valve according to the circuit valve setting.

11. The hydraulic system controller of claim 9, wherein the one or more processors are further configured to:

determine, based on the desired circuit delta-pressure and based on a flow rate limit associated with the hydraulic circuit, a circuit valve setting for the circuit valve, wherein the one or more processors, to control the hydraulic system, are configured to:

control the control device to set the position of the circuit valve according to the circuit valve setting.

12. The hydraulic system controller of claim 9, wherein the one or more processors are further configured to:

determine an operating condition associated with the hydraulic circuit; and determine, based on the operating condition, a flow rate limit associated with the hydraulic circuit, wherein the hydraulic system is controlled further based on the flow rate limit.

13. The hydraulic system controller of claim 9, wherein the one or more processors, to determine the desired circuit delta-pressure, are configured to:

determine the desired circuit delta-pressure based on the hydraulic flow command and based on a circuit pressure of the hydraulic circuit.

14. The hydraulic system controller of claim 13, wherein the circuit pressure corresponds to an operating pressure received from a pressure sensor of the hydraulic circuit.

15. The hydraulic system controller of claim 9, wherein the desired circuit delta-pressure is based on a difference between an operating pressure, received from a pressure sensor of the hydraulic circuit, and a desired pressure that is based on the hydraulic flow command.

16. The hydraulic system controller of claim 9, wherein the one or more processors are further configured to:

determine the hydraulic flow command based on an operating condition of the hydraulic circuit, the hydraulic system, or a machine that includes the hydraulic system.

17. A non-transitory computer-readable medium storing a set of instructions, the set of instructions comprising:

one or more instructions that, when executed by one or more processors, cause the one or more processors to:

determine that a hydraulic flow command, for a hydraulic circuit of a hydraulic system, is not associated with a prioritized hydraulic circuit;

determine, after determining that the hydraulic flow command is not associated with a prioritized hydraulic circuit, a desired circuit delta-pressure for the hydraulic circuit based on the hydraulic flow command; and control the hydraulic system based on the desired circuit delta-pressure.

18. The non-transitory computer-readable medium of claim 17, wherein the one or more instructions further cause the one or more processors to:

determine an operating condition associated with the hydraulic circuit; and determine, based on the operating condition, a flow rate limit associated with the hydraulic circuit, wherein the hydraulic system is controlled further based on the flow rate limit.

19. The non-transitory computer-readable medium of claim 17, wherein the one or more instructions, that cause the one or more processors to determine the desired circuit delta-pressure, cause the one or more processors to:

determine a desired circuit delta-pressure for the hydraulic circuit based on the hydraulic flow command and based on a pressure associated with the hydraulic circuit.

20. The non-transitory computer-readable medium of claim 19, wherein the pressure associated with the hydraulic circuit is an operating pressure received from a pressure sensor of the hydraulic circuit.

* * * * *